US006405420B1

(12) United States Patent
Donhauser et al.

(10) Patent No.: US 6,405,420 B1
(45) Date of Patent: Jun. 18, 2002

(54) TOOL FOR APPLYING PUNCHED RIVETS

(75) Inventors: Georg Donhauser, Amberg; Reinhard Mauermann, Dresden; Gunter Quaisser, Heidenau; Wolfgang Voelkner, Dresden; Michael Zimmermann, Aachen, all of (DE)

(73) Assignee: Kerb-Konus-Vertriebs-GmbH, Amberg (DE)

( * ) Notice: Subject to any disclaimer, the term of this patent is extended or adjusted under 35 U.S.C. 154(b) by 0 days.

(21) Appl. No.: 09/807,213

(22) PCT Filed: Oct. 14, 1999

(86) PCT No.: PCT/DE99/03302

§ 371 (c)(1),
(2), (4) Date: Apr. 11, 2001

(87) PCT Pub. No.: WO00/23213

PCT Pub. Date: Apr. 27, 2000

(30) Foreign Application Priority Data

Oct. 17, 1998 (DE) ..... 198 47 980

(51) Int. Cl.[7] ..... B21J 15/10; B21B 5/06
(52) U.S. Cl. ..... 29/243.2; 29/243.53; 29/243.519
(58) Field of Search ..... 29/243.53, 243.519, 29/243.517, 432.2

(56) References Cited

U.S. PATENT DOCUMENTS 2,465,534 A * 3/1949 Havener ..... 29/243.519
3,072,279 A 1/1963 Ikelheimer
3,731,369 A * 5/1973 Johnson ..... 29/243.53
5,174,018 A * 12/1992 Muller ..... 29/798
5,361,473 A * 11/1994 Landes ..... 29/243.53
5,752,305 A * 5/1998 Cotterill et al. ..... 29/243.2

FOREIGN PATENT DOCUMENTS

| | | |
|---|---|---|
| DE | 4419065 | 12/1995 |
| EP | 0541148 | 3/1993 |

* cited by examiner

*Primary Examiner*—David Jones
(74) *Attorney, Agent, or Firm*—Liniak, Berenato, Longacre & White

(57) ABSTRACT

The invention relates to a tool for applying punched rivets, either full rivets or semi-tubular rivets. The tool having a blank holder for pretensioning assembly pieces, especially metal sheets; a rivet punch movable in an axial direction within a cylinder of the blank holder; and a die that is arranged opposite the blank holder and punch and provided with an annular prominence on an end face thereof and facing the rivet punch. A radial outside section of said end face concentrically surrounds said annular prominence, the outside section of said end face being displaceable relative to the annular prominence as a function of one of the penetration depth of the rivet into the assembly pieces and the force that the rivet punch exerts on the rivet.

7 Claims, 4 Drawing Sheets

TOOL FOR APPLYING PUNCHED RIVETS

The invention relates to a tool for setting self-piercing rivets, in particular solid rivets or semitubular rivets, having a hold-down for prestressing the parts to be joined, in particular sheets, a riveting punch which is guided so as to be axially movable in a cylinder of the hold-down and can be acted upon by a force, and a die which is opposite the hold-down and has a prominence on a section of its end face facing the riveting punch.

The setting of rivets is described in detail, for example, in the publication "Nietsysteme, Verbindungen mit Zukunft" [Riveting systems, joints with a future] (cf. U. Klemens and O. Hahn: Nietsysteme, Verbindungen mit Zukunft [Riveting systems, joints with a future] publishing association: Interessensgemeinschaft Umformtechnisches Fügen und Laboratorium für Werkstoff-und Fügetechnik der Universität-GM Paderborn.-Sonderausgabe-Holzminden: Hinrichsen, 1994, pages 18 to 20). During self-piercing riveting with a solid rivet, complete filling of the annular groove of the rivet by the die-side sheet is an essential condition for high transmittable forces. With the known tools, however, this filling of the annular groove of the rivet is not always completely successful This is due to the fact that, when a solid rivet is being set in the die-side sheet, locally undesirable deformations may already occur at the start of the riveting operation. The deformations occur at the outer margin of the circular-ring-shaped prominence of the end face of the die. In the further course of the embossing operation of the riveting process, the displaced material which has flowed into the deformations is then unavailable for filling the annular groove of the solid rivet. The result is that the riveted connection produced in this way does not achieve the strength which it should have.

During self-piercing riveting with semitubular rivets, an important parameter to achieve is a considerable spread of the rivet shank, this parameter having a substantial effect on the forces which can be transmitted by the connection. The upsetting of the semitubular rivet is intended to achieve gap-free positive locking of the parts to be joined. However, practical experience with the use of the known tools, and in particular when riveting sheets which are relatively hard compared with the hardness of the semitubular rivet, has also shown that the rivet foot is not sufficiently spread and is then upset to a pronounced degree. A proper undercut, which is actually decisive for the strength of the connection, is not achieved.

The object of the present invention, which arises from these shortcomings with the use of known tools for setting self-piercing rivets, and in particular also when riveting sheets which are relatively hard compared with the hardness of self-piercing rivets, is to develop the known tools in such a way that the abovedescribed defects in the finished riveted connection do not occur. At the same time, the development of the known tools is to be simple, uncomplicated and inexpensive.

To achieve the object, provision is made for the end face of the die to be split into sections outside the prominence, and for the individual sections of the end face to be made so as to be mutually displaceable in the axial direction as a function of the penetration depth of the respective self-piercing rivet into the parts to be joined or of the force which the riveting punch exerts on the self-piercing rivet. In this way, when a solid rivet is being used, for example, the generation of an undesirable local deformation in the die-side sheet at the start of the riveting operation is effectively prevented. In this phase, those sections of the end face of the die which are located outside is then upset to a pronounced degree. A proper undercut, which is actually decisive for the strength of the connection, is not achieved.

In Document D1, according to DE-A-44 19 065, a tool for setting tubular rivets, for example, has been disclosed, having a hold-down, for prestressing sheets of different thickness, a riveting punch which is guided so as to be axially movable in a cylinder of the hold-down and can be acted upon by a force, and a die which is opposite the hold-down and has a prominence on a section of its end face facing the riveting punch, the end face of the die being split into sections radially outside the prominence, namely into an inner mandrel section having a prominence and an outer annular die section, and the individual sections of the end face are mutually displaceable in the axial direction as a function of the penetration depth of the tubular rivet into the sheets or of the force which the riveting punch exerts on the tubular rivet. This teaching for the setting of tubular rivets cannot be readily applied to the setting of solid rivets, for it is necessary in the case of solid rivets as self-piercing rivets to completely fill an annular groove in the shank of the solid rivet with the material of the parts to be joined in order to obtain a satisfactory riveted joint. its annular prominence bear firmly against the die-side sheet and prevent the generation of a deformation. During the further progress of the riveting operation, these surface sections then give way in the axial direction relative to the annular prominence. The annular prominence retains its original position. That material of the die-side sheet which is otherwise "lost" due to the undesirable deformation is therefore retained and, as intended, can flow into the annular groove of the solid rivet and completely fill the latter.

The procedure is different when processing semitubular rivets. Here, the hump-shaped prominence in the center of the end face of the die projects relative to the surrounding surface sections at the start of the riveting operation. The result of this is that the parts of the material to be joined which are located under the recess of the semitubular rivet are first of all caused to be bent into the recess of the semitubular rivet in a curved manner. With the progress of the riveting operation, the hump-shaped central prominence of the die then gives way in the axial direction, so that a riveted connection can be produced in which all the components associated with one another are connected in the predetermined manner. In particular, a closing head of regular form is obtained, with which the semitubular rivet is sufficiently spread without excessive upsetting of its cutting margins and where the sheets to be riveted to one another have flowed into the recess of the semitubular rivet to a uniform thickness.

A further advantage of the development according to the invention consists in the fact that the especially high rigidity, required according to the prior art, of the joining device is no longer necessary to the same extent. Since the improved riveting tools produce a continuous flow and joining of the parts to be connected to one another, especially high rigidity of the joining devices can largely be dispensed with, which enables the tools to be used in a more universal manner.

In the simplest case, the force under which the sections of the end face which surround the prominence of the end face are axially displaceable relative to the prominence is produced by the force of a preloaded spring as a function of the penetration depth of the self-piercing rivet into the sheets to be joined. This involves a passive control of the axial movement of the surface sections of the die. Such a control is preferably applied if a simple and continuously increasing force/displacement characteristic for the joining process produces a good result. In this case, simple control can be realized with mechanical elements, e.g. disk, helical or plastic springs. The position and shape of the characteristic are predetermined here within the tool by the rigidity and preloading of the springs.

It is far more efficient, however, if this force is set as a function of the pressure of the riveting punch. In this case, the axial displacement of the end face can at the same time also be set as a function of the hardness of the materials to be riveted. In the simplest case, a hydraulic unit which is known per se and has an adjustable pressure relief valve is used as the pressure-medium source.

In particular, the tool according to the invention is configured in such a way that, for setting a solid rivet, the sections of the end face of the die which concentrically surround the annular prominence of this end face are designed so as to be axially displaceable relative to the annular prominence. In the other case, when setting a semitubular rivet, where a hump-shaped prominence is arranged in the center of the end face of the die, this end face is configured in such a way that that surface section of the end face which has the hump-shaped prominence is axially displaceable relative to the outer sections of the end face of the die which surround it concentrically.

By means of a hydraulic unit, variable force/displacement characteristics can be set externally, i.e. they can be freely programmed. In the case of programmable controls, electrohydraulic servo valves known per se are used for setting the characteristic. The strength of the riveted connection, in particular the dynamic strength, can be substantially improved with a variable characteristic, and in some applications can also be achieved only in this way.

When setting solid rivets, the cutting process can be influenced in a positive manner with regard to a neat cut surface in the punched hole and with regard to the prestressing state after the riveting. These important parameters depend on increasing wear of the cutting edge of the die. The wear of this cutting edge is compensated for by increasing the axial height of the annular prominence of the cutting edge of the die as wear progresses. This adjustment may be effected continuously and externally. In the simplest case, the volume of the hydraulic pressure medium is reduced if the outer die part is designed as a piston.

When setting semitubular rivets, the sequence of motion is set in such a way that a large counterforce is preset at the start of the riveting operation. This promotes the spreading of the semitubular rivet at the start of the riveting operation. During the further course, a counterforce which can be decreased continuously is produced in order to obtain an especially good undercut in this way.

The invention is described in more detail below with reference to two exemplary embodiments. In the drawing, which in each case is not true to scale and is partly in greatly simplified sectional representation:

Figure 1:
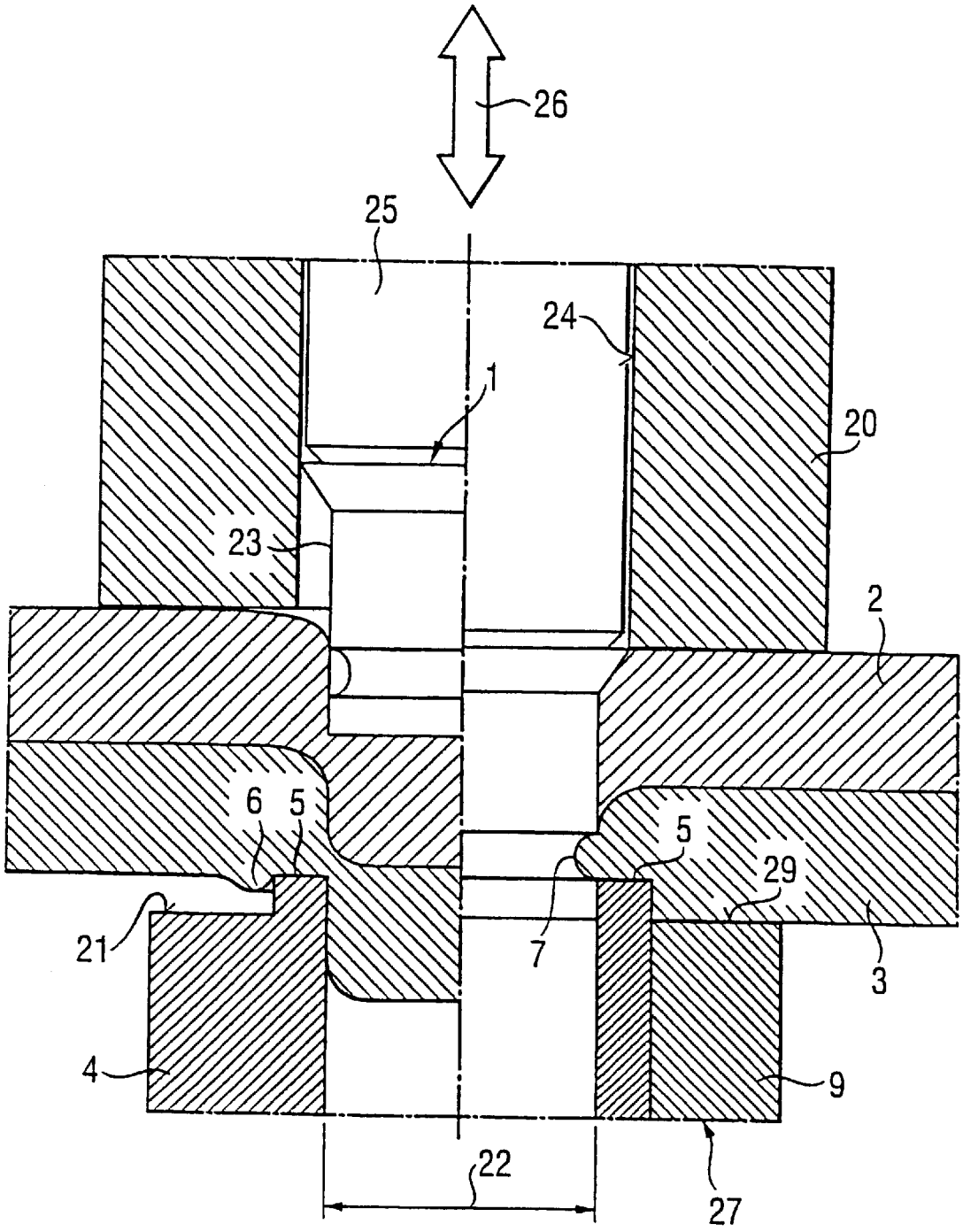
FIG. 1 shows the mode of operation of the tool when setting a solid rivet.

The left-hand half of FIG. 1 represents the setting of a solid rivet 1 with conventional tools. The sheets 2 and 3 are to be connected to one another by means of the solid rivet 1. To this end, the sheets 2 and 3 are prestressed under the pressure of a hold-down 20 on the end face 21 of a die 4. The end face 21 has an annular prominence 5, the inside diameter 22 of which is of such a size that the shank 23 of the solid rivet 1 fits in while maintaining a predetermined cutting clearance. The hold-down 20 has a cylinder 24 in which the riveting punch 25 is guided so as to be movable in the axial direction 26. Under the force of the riveting punch 25, the solid rivet 1 is punched through the sheets 2 and 3, which at the same time deform in the manner shown on the left-hand side of FIG. 1. In the process, a deformation 6 occurs locally at the start on the die-side sheet 3 outside the annular prominence 5. This deformation 6 is undesirable, since that material of the die-side sheet 3 which prematurely flows into the deformation is subsequently absent, i.e. when the riveted joint is completely embossed, in order to completely fill the annular groove 7 in the shank 23 of the solid rivet 1.

To avoid the defect described above, the end face 21 of the die 27 is subdivided into sections 5 and 29. The annular prominence 5 in FIG. 2 forms the front-end termination of a hollow punch 11 which is firmly connected to the die housing 28. A punch element 9 is mounted so as to be movable in the axial direction 26 in the die housing 28, which is designed like a cylinder. The punch element 9 surrounds the hollow punch 11 concentrically. The end face 29 of the punch element 9 and the annular prominence 5 of the hollow punch 11 together form the closed end face 21 of the die 27. When the end face 21 is closed, the punch element 9 is located at a top stop 10 of the die 27.

When the punch element 9 is displaced in the axial direction 26 relative to the hollow punch 11, the punch element 9 strikes a bottom stop 12. During this axial displacement of the punch element 9 relative to the hollow punch 11, an offset 8 by which the end face 29 of the punch element 9 is set back relative to the annular prominence 5 of the hollow punch 11 occurs at the radially outer margin of the annular prominence 5. However, the offset 8 does not occur until after the force of the riveting punch 25 has reached a certain magnitude. To this end, the annular space 30, below the punch element 9, is connected to a pressure-medium source 31 which is known per se and may also have an adjustable pressure relief valve 32. Instead of the pressure-medium source 31, a powerful spring assembly 33 (indicated by dashed lines) which is arranged in the annular space 30 may also be provided. The springs 33 are preloaded. In any case, the section 29 of the end face 21 of the die 27 is held in a plane with the end face of the annular prominence 5 until the solid rivet 1 has penetrated far enough into the sheets 2 and 3 to be riveted. The closed end face 21 at the start of the riveting operation prevents the deformation 6 from being able to form on the bottom sheet 3. The giving-way of the surface section 29 during the further course of the riveting operation then results in the annular groove 7 of the solid rivet 1 being sufficiently filled, as shown on the right-hand half of FIG. 1.

Figure 3:
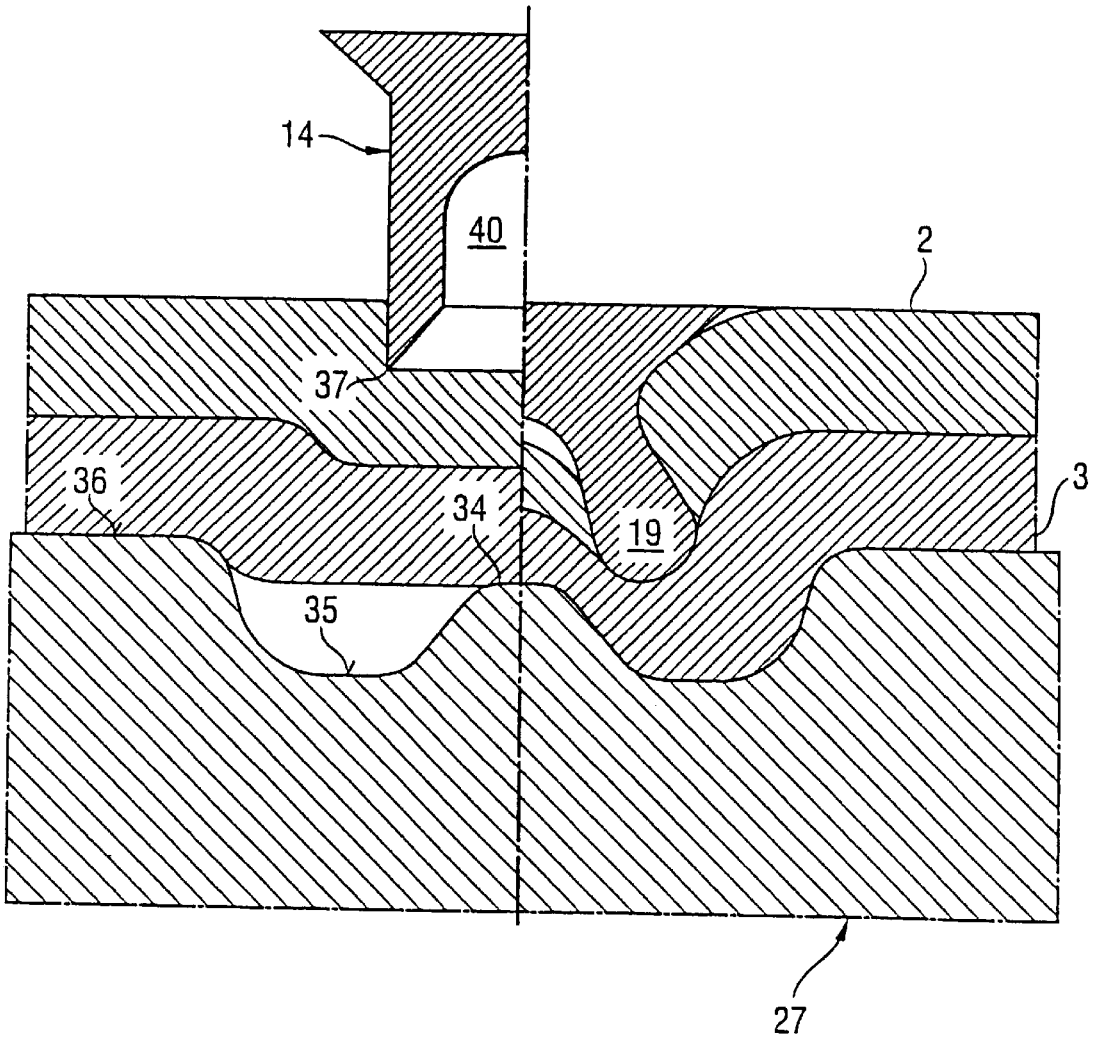
FIG. 3 shows the mode of operation of a known tool when setting a semitubular rivet.

FIG. 3 shows first of all the riveting of two sheets 2 and 3 by means of a semitubular rivet 14 in a conventional manner. The cutting phase is shown on the left-hand half of FIG. 3 and the embossing phase is shown on the right-hand half. The die 27 has a hump-shaped prominence 34 in its center. The hump-shaped prominence 34 projects from a depression 35 which has the closed end face 36 of the die 27 for the semitubular rivet 14. Depending on the hardness of the sheets 2 and 3 to be riveted compared with the hardness of the semitubular rivet 14, a situation may occur in which the bottom cutting margin 37 of the semitubular rivet 14 is not sufficiently spread before the embossing phase but is deformed into an undesirable thickened portion 19. The occurrence of such a thickened portion 19 is regarded as defective, since it prevents sufficiently firm joining of the two sheets 2 and 3.

Figure 2:
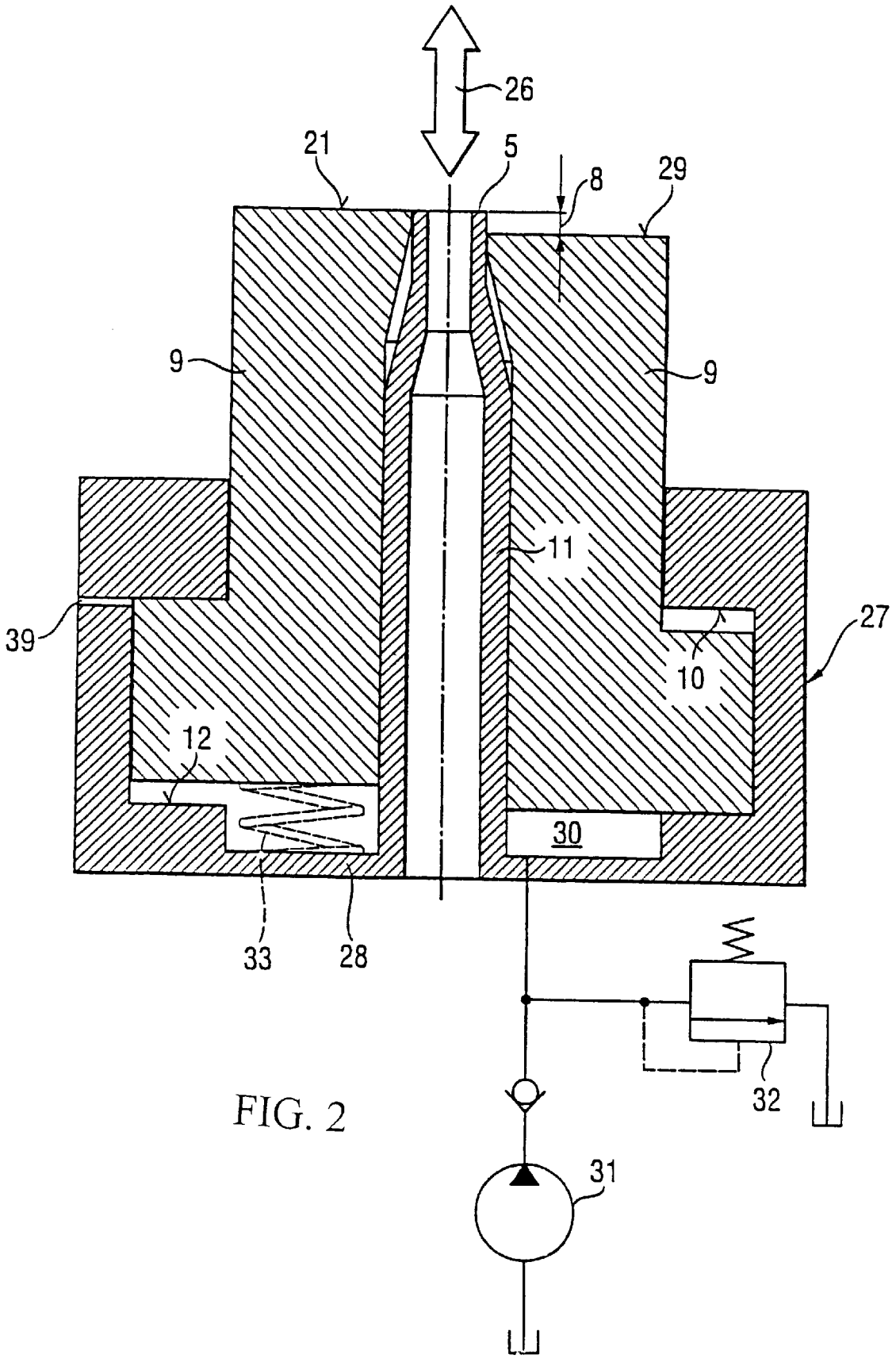
FIG. 2 shows the configuration of a die.
Figure 4:
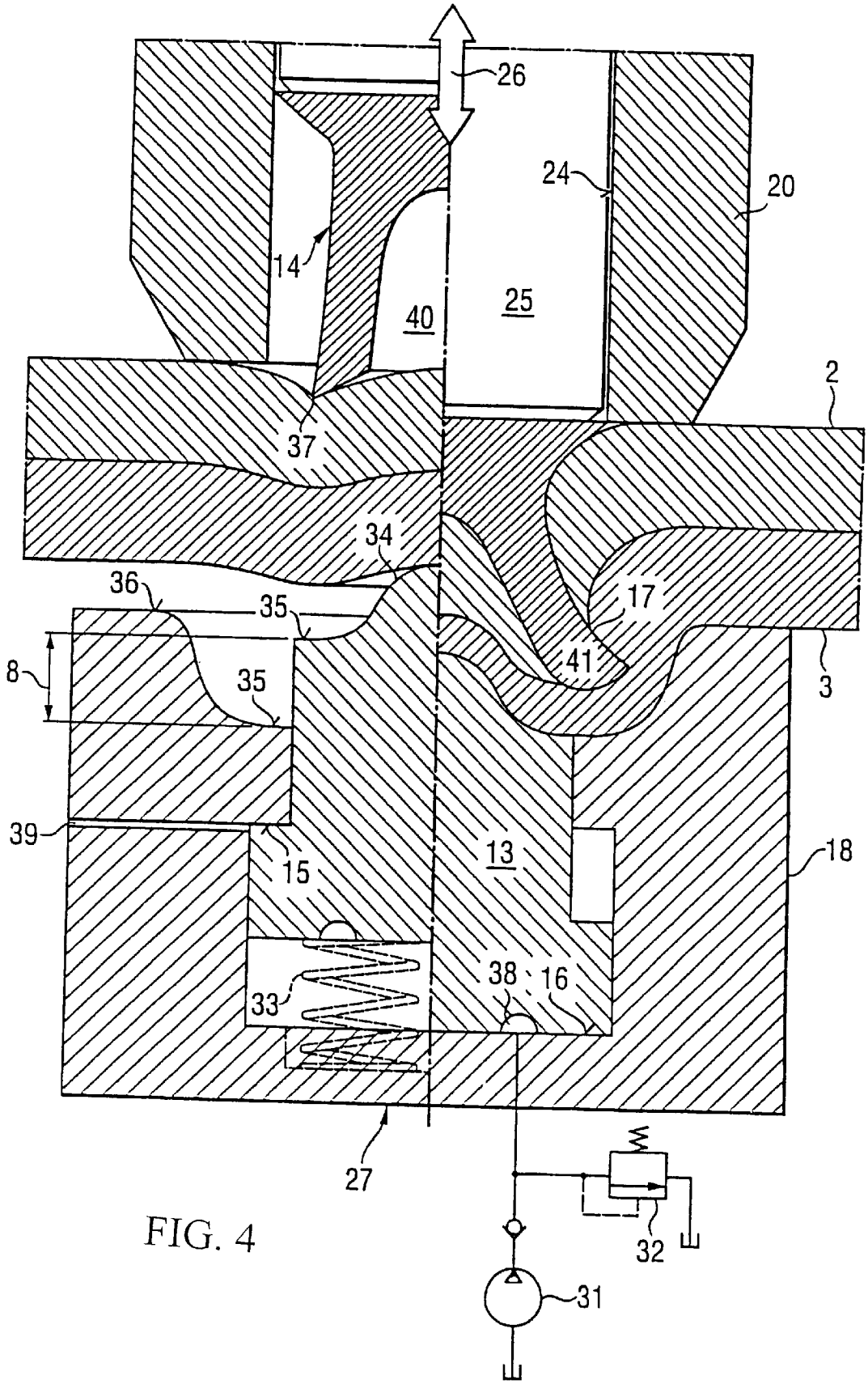
FIG. 4 shows the configuration of a die when setting a semitubular rivet.

The aim is to achieve a neat undercut 17 as shown on the right-hand half of FIG. 4. To this end, the die 27 is also of split design in this case and has a fixed outer part 18, which constitutes a cylinder. A piston 13 is mounted inside the outer part 18 so as to be movable in the axial direction 26. This piston 13 can move inside the outer part 18 between a bottom stop 16 and a top stop 15. The end face of the piston 13 has the hump-shaped prominence 34 already described in the center of the die 27. However, the end face of the piston 13 at the same time also forms a section of the depression 35, which serves to spread the cutting margin 37 of the semitubular rivet 14. If the piston 13 is not under the preloading of a spring assembly 33, its underside is acted upon by a pressure medium which originates from the pressure-medium source 31, which again also has an adjustable pressure relief valve 32. An annular groove 38 ensures the inflow of the pressure medium on the underside of the piston 13, and a vent bore 39 ensures that the piston 13 can also move unimpeded up to the top stop 15. The die 27 which is also shown in FIG. 2 has such a vent bore 39.

Under the effect of the spring assembly 33 (indicated by dashed lines)—it being assumed that the springs 33 are preloaded—or under the effect of the pressure medium delivered by the pressure-medium source 1, the piston 13 is extended in the axial direction 26 at the start of the riveting operation, as a result of which the end face 36, which is otherwise closed, of the die 27 receives an offset 8. The force which acts on the piston 13 causes the two sheets 2 and 3 to be bent in a curved manner into the recess 40 of the semitubular rivet 14 at the start of the riveting operation, as can be seen on the left-hand side of FIG. 4. As the riveting operation progresses, the piston 13 then gives way in the axial direction 26, and an ideal closing head 41 is obtained, which can be seen on the right-hand half of FIG. 4.

LIST OF REFERENCE NUMERALS

1 Solid rivet
2 Sheet
3 Sheet
4 Die
5 Annular prominence
6 Local deformation
7 Annular groove
8 Offset
9 Punch element
10 Top stop
11 Hollow punch
12 Bottom stop
13 Piston
14 Semitubular rivet
15 Top stop
16 Bottom stop
17 Undercut
18 Outer part
19 Thickened portion
20 Hold-down
21 End face
22 Inside diameter
23 Shank
24 Cylinder
25 Riveting punch
26 Axial direction
27 Die
28 Die housing
29 End face
30 Annular space
31 Pressure-medium source
32 Pressure relief valve
33 Spring assembly
34 Hump-shaped prominence
35 Depression
36 End face
37 Bottom cutting margin
38 Annular groove
39 Vent bore
40 Recess
41 Closing head

What is claimed is:

1. A tool for setting a self-piercing solid rivet penetrating into a first and a second sheet of metal to be joined, comprising:

a hold-down for prestressing said first and said second sheet;

a cylinder defining an interior space within said hold-down;

a riveting punch guided by said cylinder, moveable by a first riveting force in an axial direction relative to said cylinder; and a die opposite said hold-down having an end face, said end face having an annular prominence facing said riveting punch and a radially outside section concentrically surrounding said annular prominence, wherein said annular prominence and said radially outside section of said end face form a punch element, said radially outside section being displaceable in said axial direction under a second riveting force, wherein said second riveting force is a function of a penetration depth of said self-piercing solid rivet into said first and said second sheet.

2. The tool for setting a self-piercing solid rivet penetrating into a first and a second sheet of metal to be joined according to claim 1 wherein said second riveting force is generated from at least one preloaded spring disposed within said die.

3. The tool for setting a self-piercing solid rivet penetrating into a first and a second sheet of metal to be joined according to claim 1, wherein said second riveting force is generated from a pressure medium source.

4. A tool for setting a self-piercing solid rivet penetrating into a first and a second sheet of metal to be joined, comprising:

a hold-down for prestressing said first and said second sheet;

a cylinder defining an interior space within said hold-down;

a riveting punch guided by said cylinder, moveable by a first riveting force in an axial direction relative to said cylinder; and a die opposite said hold-down having an end face, said end face having an annular prominence facing said riveting punch and a radially outside section concentrically surrounding said annular prominence, wherein said annular prominence and said radially outside section of said end face form a punch element, said radially outside section being displaceable in said axial direction under a second riveting force, wherein said second riveting force is a function of said first riveting force pressing said self-piercing solid rivet into said first and said second sheet.

5. The tool for setting a self-piercing solid rivet penetrating into a first and a second sheet of metal to be joined according to claim 4, wherein said second riveting force is generated from at least one spring disposed within said die.

6. The tool for setting a self-piercing solid rivet penetrating into a first and a second sheet of metal to be joined according to claim 4, wherein said second riveting force is generated from a pressure medium source.

7. A self-piercing solid rivet and a tool for setting a self-piercing solid rivet penetrating into a first and a second sheet of metal to be joined combination, comprising:

a self-piercing solid rivet;

a hold-down for prestressing said first and said second sheet;

a cylinder defining an interior space within said hold-down;

a riveting punch guided by said cylinder, moveable by a first riveting force in an axial direction relative to said cylinder; and a die opposite said hold-down having an end face, said end face having an annular prominence facing said riveting punch and radially outside section concentrically surrounding said annular prominence, wherein said annular prominence and said radially outside section of said end face form a punch element, said radially outside section being displaceable in said axial direction under a second riveting force, wherein said second riveting force is a function of one of a penetrating depth of said self-piercing solid rivet into said first said second sheet and said first riveting force pressing said self-piercing solid rivet into said first and said second sheet.

* * * * *